US012773027B2

(12) United States Patent
D'Anjou

(10) Patent No.: US 12,773,027 B2
(45) Date of Patent: Oct. 27, 2026

(54) INSULATED AND VENTED GARMENT

(71) Applicant: 8579148 Canada Inc., Montréal (CA)

(72) Inventor: Éric D'Anjou, Magog (CA)

(73) Assignee: 8579148 Canada Inc., Montréal (CA)

( * ) Notice: Subject to any disclaimer, the term of this patent is extended or adjusted under 35 U.S.C. 154(b) by 0 days.

(21) Appl. No.: 18/997,929

(22) PCT Filed: Jun. 12, 2024

(86) PCT No.: PCT/CA2024/050793

§ 371 (c)(1),
(2) Date: Jan. 23, 2025

(87) PCT Pub. No.: WO2025/065079

PCT Pub. Date: Apr. 3, 2025

(65) Prior Publication Data

US 2025/0386887 A1 Dec. 25, 2025

Related U.S. Application Data

(60) Provisional application No. 63/540,879, filed on Sep. 27, 2023.

(51) Int. Cl.
*A41D 31/06* (2019.01)
*A41D 31/02* (2019.01)

(52) U.S. Cl.
CPC ..... *A41D 31/065* (2019.02); *A41D 31/02* (2013.01)

(58) Field of Classification Search
CPC ..... A41D 31/02; A41D 31/04; A41D 31/065; A41D 27/28; A41D 27/285; B32B 5/24; B32B 5/26; D03D 11/00; D03D 11/02; A41B 1/00
See application file for complete search history.

(56) References Cited

U.S. PATENT DOCUMENTS 2,771,661 A * 11/1956 Foster ..... D06M 17/00 428/172
4,408,356 A * 10/1983 Abrams ..... A41D 3/04 2/87
4,513,451 A 4/1985 Brown
9,950,492 B2 * 4/2018 Banowit ..... B32B 3/20
10,687,572 B2 6/2020 Baker
(Continued)

FOREIGN PATENT DOCUMENTS

CA 2853056 C 5/2013
JP 5368327 B2 12/2013

*Primary Examiner* — Katherine M Moran
(74) *Attorney, Agent, or Firm* — McCarthy Tétrault LLP.; Amy Fong

(57) ABSTRACT

The present invention relates to textiles and garments that provide both insulation and ventilation. The textile includes a mesh layer and a plurality of insulated baffles, each one of the plurality of insulated baffles defined by a first longitudinal edge and a second longitudinal edge. Each one of the plurality of insulated baffles is attached to the mesh layer along the first longitudinal edge of the baffle while the second longitudinal edge of the baffle is left unattached, allowing moisture to escape through the mesh layer and under the baffle. The plurality of insulated baffles is attached to the mesh layer in an overlapping manner. The textile may be incorporated into a garment, such as the back panel of a jacket, to provide insulation and ventilation to the wearer.

20 Claims, 3 Drawing Sheets

(56) References Cited

U.S. PATENT DOCUMENTS

| | | | | |
|---|---|---|---|---|
| 10,966,477 | B2 | 4/2021 | Baker | |
| 11,406,148 | B2 | 8/2022 | Ingram et al. | |
| 11,857,003 | B2 | 1/2024 | Bailey et al. | |
| 2011/0094004 | A1* | 4/2011 | Li | A47G 9/086<br>112/475.08 |
| 2013/0177731 | A1* | 7/2013 | Moriarty | A41D 31/145<br>5/413 R |
| 2015/0201683 | A1* | 7/2015 | Maud | A41D 13/002<br>428/72 |
| 2018/0098588 | A1* | 4/2018 | Pezzimenti | A41D 27/28 |
| 2019/0365000 | A1 | 12/2019 | Simmons et al. | |
| 2020/0009828 | A1* | 1/2020 | Ly | B32B 5/26 |
| 2021/0156057 | A1* | 5/2021 | Ogata | D04B 1/22 |
| 2022/0232917 | A1* | 7/2022 | Lee | A47G 9/08 |
| 2022/0338576 | A1* | 10/2022 | Skurla, III | A41D 1/02 |
| 2023/0200474 | A1* | 6/2023 | Skurla, III | A41D 1/02<br>2/243.1 |

* cited by examiner

INSULATED AND VENTED GARMENT

REFERENCE TO RELATED APPLICATION

This application is a 371 of PCT Application No. PCT/CA2024/050793 filed on Jun. 12, 2024, which claims priority from U.S. Patent Application No. 63/540,879 filed on Sep. 27, 2023 entitled "INSULATED AND VENTED GARMENT". For the purposes of the United States, this application claims the benefit under 35 U.S.C. § 119 of U.S. Patent Application No. 63/540,879 filed on Sep. 27, 2023 entitled "INSULATED AND VENTED GARMENT". The entirety of the contents of the referenced applications are hereby incorporated by reference for all purposes.

REFERENCE TO RELATED APPLICATION

This application claims priority from U.S. Patent Application No. 63/540,879 filed on Sep. 27, 2023 entitled "INSULATED AND VENTED GARMENT". For the purposes of the United States, this application claims the benefit under 35 U.S.C. § 119 of U.S. Patent Application No. 63/540,879 filed on Sep. 27, 2023 entitled "INSULATED AND VENTED GARMENT". U.S. Patent Application No. 63/540,879 is incorporated herein by reference in its entirety for all purpose.

TECHNICAL FIELD

The present disclosure relates generally to textiles and apparel having insulation, and textiles and apparel having ventilation.

BACKGROUND

There are activewear, sportswear, athletic wear or outerwear incorporating features or materials providing warmth and insulation during wear. There are also activewear, sportswear, athletic wear or outerwear incorporating features or materials providing ventilation during wear. Examples include:

- Garments having zippers in certain areas (such as "pit zips" or ventilation zippers located in the underarm area of a hard-shell jacket); the zippers can be unzipped to provide ventilation openings in the garment.
- US20190365000A1 describing garments having flaps that open in the presence of the external stimulus (such as moisture) for increased ventilation.
- U.S. Pat. No. 11,406,148B2 describing garments having fixed baffles and venting provided in between the baffles. The venting is provided through a plurality of openings extending through panels in the garment.
- U.S. Pat. No. 10,966,477B2 describing a puffer jacket having a back panel with an alternating arrangement of baffles 18*a* containing insulation and baffles 18*b* containing no insulation. The baffles are fixed with lines of stitching.
- U.S. Pat. No. 10,687,572B2 describing a garment having an overlap panel that conceals an inner panel having ventilation holes.
- CA2853056C describing a garment having a protective shell layer and an insulating layer having holes for holding air.

Designing a jacket or other garment for warmth and retention of heat requires different construction and materials than for what is required for ventilation. In general, the construction for ventilation is opposite to what is required for warmth or insulation. For example, ventilation generally requires openings in the material to permit air flow through the material. Providing openings, however, reduces the insulation and warmth of the garment. By contrast, warmth generally requires the use of thicker materials, and designing for full coverage to retain heat and protect the wearer against the elements; this tends to inhibit air flow and ventilation.

Given such competing requirements, garments typically focus on providing either ventilation (such as "pit zips", or other ventilation features as described in US20190365000A1, U.S. Pat. No. 11,406,148B2 and U.S. Pat. No. 10,687,572B2) or warmth or insulation (such as described in CA2853056C). U.S. Pat. No. 10,966,477B2 describes baffles having insulation alternating with baffles having no insulation, and the solution it teaches for ventilation is simply to provide more baffles with no insulation near the center of the back. However, providing baffles with no insulation in certain areas compromises any insulation or warmth in those areas.

There is a need to provide textiles and apparel addressing both the need for warmth and ventilation to the wearer while engaging in outdoor activity or sport. The present invention aims to provide a solution to the above-noted challenges.

SUMMARY OF THE DISCLOSURE

The following embodiments and aspects thereof are described and illustrated in conjunction with systems and methods which are meant to be exemplary and illustrative, not limiting in scope. In various embodiments, one or more of the above-described problems have been reduced or eliminated, while other embodiments are directed to other improvements.

One aspect of the invention relates to a textile for use in constructing a garment. The textile includes a mesh layer, and a plurality of insulated baffles, each one of the plurality of insulated baffles defined by a first longitudinal edge and a second longitudinal edge. Each one of the plurality of insulated baffles is attached to the mesh layer along the first longitudinal edge of the baffle while the second longitudinal edge of the baffle is left unattached, allowing moisture to escape through the mesh layer and under the baffle. The plurality of insulated baffles may be arranged in parallel rows at spaced intervals along a length of the mesh layer.

In some embodiments, the plurality of insulated baffles is attached to the mesh layer in an overlapping manner. The plurality of insulated baffles comprises an upper baffle and a lower baffle adjacent to the upper baffle, wherein the upper baffle and lower baffle are attached to the mesh layer such that the second longitudinal edge of the upper baffle is below the first longitudinal edge of the lower baffle.

The mesh layer may be a stretch mesh material. Each one of the plurality of insulated baffles may include an exterior fabric forming a casing, and insulation material located within the casing.

Some embodiments include one or more closures for selectively opening and closing the plurality of insulated baffles. The closures may be one or more of: button fasteners, zippers, hook and loop tape, magnetic closures, ties, and the like.

Another aspect relates to apparel incorporating a textile having insulated baffles attached to a mesh layer as described herein.

Another aspect relates to a method for constructing a textile, the method including providing a mesh layer; providing a plurality of casings, each one of the plurality of casings formed from a rectangular fabric piece folded longitudinally to form the casing, wherein the casing is defined by a first longitudinal edge and a second longitudinal edge; arranging the plurality of casings at spaced intervals along a length of the mesh layer; sewing each one of the plurality of casings to the mesh layer along the first longitudinal edge while leaving the second longitudinal edge unattached; and inserting insulation material into each one of the plurality of casings.

A further aspect relates to textiles manufactured in accordance with methods described herein, incorporating a mesh layer and a plurality of insulated baffles attached to the mesh layer along a first longitudinal edge of each baffle.

In addition to the exemplary aspects and embodiments described above, further aspects and embodiments will become apparent by reference to the drawings and by study of the following detailed descriptions.

BRIEF DESCRIPTION OF THE DRAWINGS

Features and advantages of the embodiments of the present invention will become apparent from the following detailed description, taken in with reference to the appended drawings in which.

DETAILED DESCRIPTION

The description which follows, and the embodiments described therein, are provided by way of illustration of examples of particular embodiments of the principles of the present invention. These examples are provided for the purposes of explanation, and not limitation, of those principles and of the invention.

Described herein are insulated and vented textiles, and garments incorporating such textiles. In particular embodiments, the textile incorporates a plurality of exterior flaps, wherein the flaps are made of insulated material. The flaps may be arranged and attached to a mesh layer or backing so as to permit the flow and circulation of moisture and air under the flaps and through the mesh layer. In a particular embodiment, the flaps are arranged in an overlapping manner over the mesh layer. In another embodiment, the flaps are arranged in a non-overlapping manner over the mesh layer.

Figure 1:
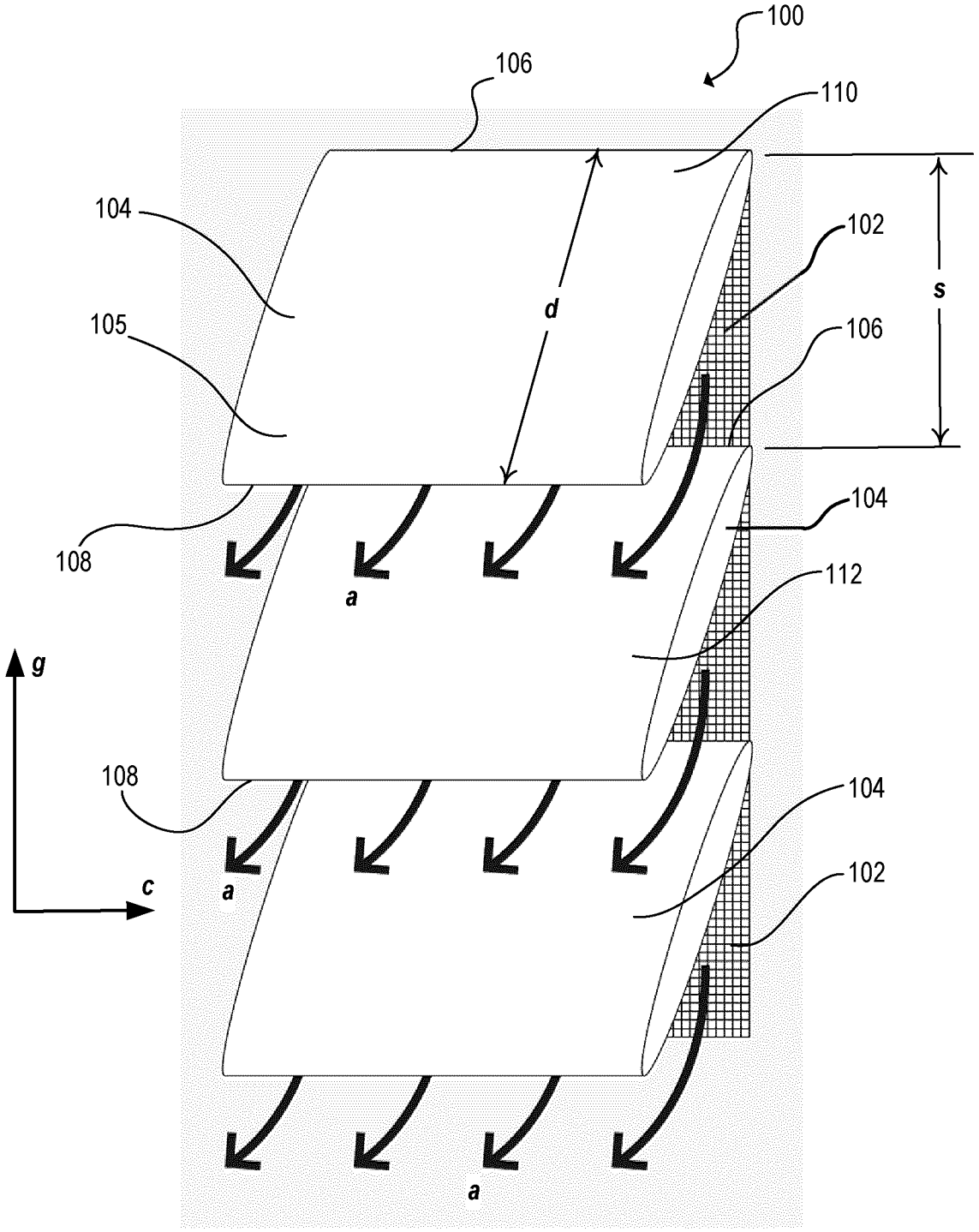
FIG. 1 illustrates an insulated and vented textile according to one embodiment.
Figure 2:
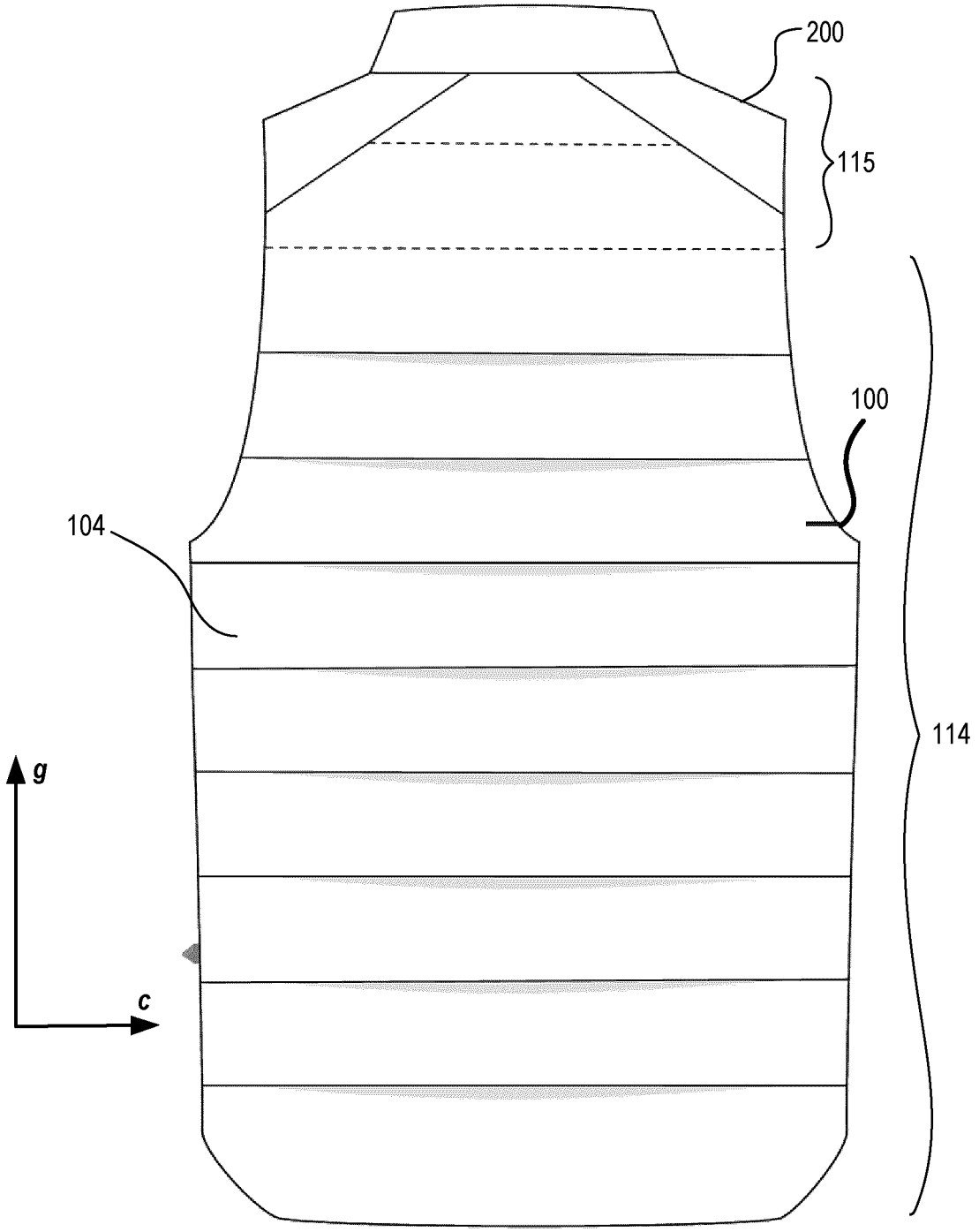
FIG. 2 shows an exemplary garment that incorporates the insulated and vented textile of FIG. 1.

FIG. 1 shows a portion of an insulated and vented textile 100 that may be used to manufacture a garment. FIG. 2 shows the back of a garment 200 incorporating the insulated and vented textile 100 of FIG. 1. At first glance, garment 200 looks like a regular puffer jacket. However, the construction of garment 200 is vastly different from a regular puffer jacket. A regular puffer jacket is typically made from conventional quilting techniques wherein the jacket is formed of three layers (a batting layer sandwiched between an outer layer and an interior layer) which are each cut using the same pattern piece (with the same size and shape) and sewn together to construct the jacket. By contrast, insulated and ventilated textile 100 in garment 200 requires many more pieces of fabric, as it comprises baffles 104 which are individually attached to a mesh layer 102. Each baffle 104 is attached to the mesh layer 102 only along one edge (e.g. the first longitudinal edge 106, which is the upper edge of each baffle 104 in the illustrated embodiment of FIG. 1), and it is left unattached along the other edge (e.g. the second longitudinal edge 108, which is the lower edge of each baffle 104 in the illustrated embodiment of FIG. 1). This feature increases breathability of the garment, since air and moisture are able to circulate through the mesh layer 102 and under the baffle 104. In addition, the baffles 104 may be attached in overlapping fashion as best seen in FIG. 1, keeping out the cold and retaining heat of the wearer (thereby facilitating the insulating properties of the textile 100). Thus, the baffle and mesh construction of textile 100 provides advantages in providing for both insulation and venting (air/moisture circulation), over a conventional quilted or puffer jacket.

Textile 100 incorporates multiple layers and materials. In the illustrated embodiment seen in FIG. 1, textile 100 includes a mesh layer 102 and a plurality of insulated baffles 104, consisting of flaps arranged over the mesh layer 102. Mesh layer 102 is preferably a durable fabric since it provides the foundation of the textile 100 and supports a plurality of insulated baffles 104. For increased comfort and ease of movement, the mesh layer 102 may be made of a stretch mesh fabric. Each of the baffles 104 comprises an exterior fabric 105 forming a casing for insulation material that is located in the interior of each baffle 104. The exterior fabric 105 and mesh layer 102 may comprise synthetic materials such as polyester, nylon, spandex, and the like. Preferably, exterior fabric 105 is made from a wind-resistant and/or water-resistant or water-repellant material, and mesh layer 102 is made from a breathable material. The insulation material located in the interior of each baffle 104 may be water-resistant or water-repellent material, and may comprise synthetic insulating material such as polyester fibers, or natural insulating material such as cotton fiber, wool, down and/or feathers, or a combination of two or more of the foregoing types of fiber or material.

Referring to FIG. 1, textile 100 has a grainline direction g defined along a length of the textile and a cross grain direction c defined perpendicularly to the grainline direction g (i.e. along a width of the textile). Baffles 104 are arranged with their length parallel to the cross grain direction c, or in other words, perpendicular to the grainline direction g. Baffles 104 are attached to the mesh layer 102 at intervals s along the grainline direction g (i.e. at spaced intervals along a length of the mesh layer 102). As seen in the illustrated embodiment of FIG. 1, the baffles 104 are spaced equally apart along the grainline direction g. In other embodiments the spacing between the baffles 104 is not equal, and varies along the grainline direction g. Textile 100 may be incorporated into garment 200 such that the grainline direction g is oriented generally vertically when the garment is worn (i.e. in a generally upward/downward direction as the wearer is standing upright). This is seen in FIG. 2, where the garment 200 is a jacket, and wherein a panel 114 in the back of the jacket comprises textile 100. For illustrative purposes, FIG. 2 shows only the back of the garment 200, and it does not show the sleeves of the garment. In other embodiments, textile 100 is incorporated into garment 200 so that the grainline direction g is oriented along a different direction when the garment is worn (e.g. in a horizontal direction or diagonally). In other embodiments, baffles 104 may be arranged so that their length is parallel to the grainline direction g instead of the cross grain direction c. In some embodiments, the textile 100 may have its grainline and cross grain directions reversed.

Each baffle 104 is defined by a pair of longitudinal edges and preferably extends across the full width of mesh layer 102. In particular, each baffle 104 is defined by a first longitudinal edge 106 (also referred to herein as the fixed edge) along which the baffle 104 is stitched down or otherwise attached to mesh layer 102. Each baffle 104 also is defined by a second longitudinal edge 108 (also referred to herein as the free edge), which is left unattached (i.e. not attached to mesh layer 102). The fixed edge therefore functions as a hinge about which the baffle 104 can move with some limited rotation as the free edge is lifted away from the mesh layer 102. In the embodiment of FIG. 1, the first longitudinal edge 106 (which is the fixed edge) is the upper edge of the baffle 104, while the second longitudinal edge 108 (which is the free edge) is the lower edge of the baffle 104. In other embodiments, the first longitudinal edge 106 is the lower edge of the baffle 104, while the second longitudinal edge 108 is the upper edge of the baffle 104; such orientation may allow gravity to act on or pull down on the baffles 104 and keep them at least partially open during wear (assuming that during wear, textile 100 is generally oriented vertically or along a direction with a vertical component).

To increase the warmth of the garment, in FIG. 1 the baffles 104 may be arranged and stitched down in an overlapping manner, i.e. at spaced intervals s along a length of the mesh layer 102 wherein s is less than the distance d between the first longitudinal edge 106 and second longitudinal edge 108 of each baffle 104. As such, for a pair of adjacent baffles comprising an upper baffle 110 and a lower baffle 112, the second longitudinal edge 108 of the upper baffle 110 is positioned below the first longitudinal edge 106 of the lower baffle 112.

There are challenges in designing and constructing the insulated baffles 104 and attaching them to the mesh 102. Typically, quilted garments are made by sewing the outer and inner fabrics together with insulation material (e.g. a layer of synthetic batting) sandwiched between the outer and inner fabrics. Quilting is then done by sewing through all of the layers (including the outer and inner layers and the middle batting) to secure the batting in place between the outer and inner fabrics. Construction techniques for making the insulated and vented textile 100 are more technical compared to conventional quilted garments (which require less pieces of fabric). In a particular embodiment as described in more detail below, each of the baffles 104 for the insulated and ventilated textile 100 is made from an individual pattern piece that is folded and sewn in a particular manner and then sewn onto the mesh along one edge so as to create a casing. The casing is stuffed with insulation material to form an insulated baffle 104.

Figure 3A:
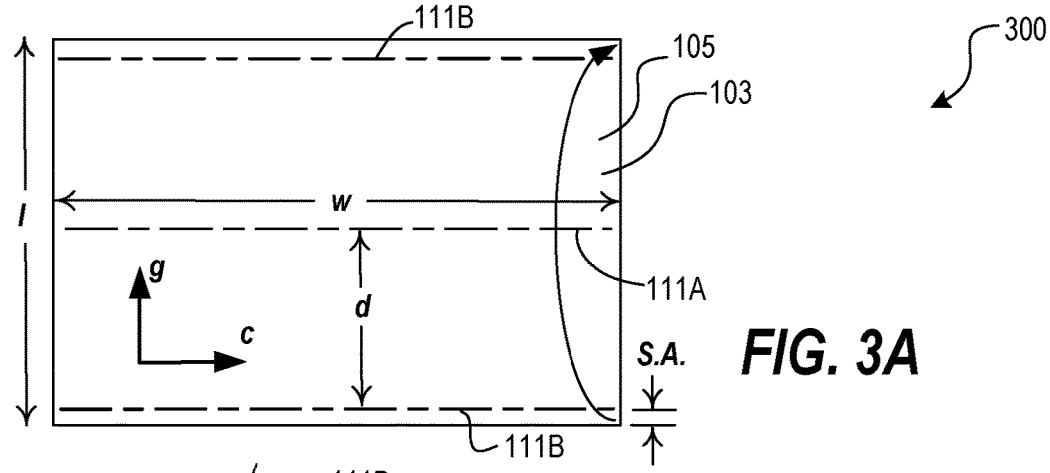
FIGS. 3A, 3B, 3C, 3D and 3E (collectively, FIG. 3) illustrate the steps of a method of construction that may be used in a certain embodiment to construct an insulated and vented textile.
Figure 3B:
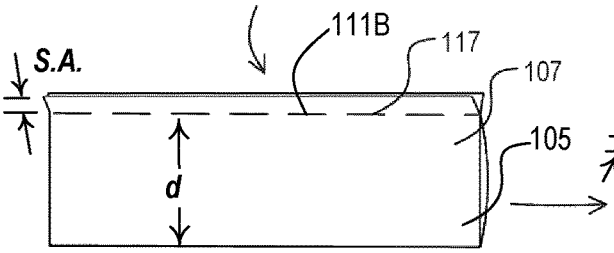
Figure 3C:
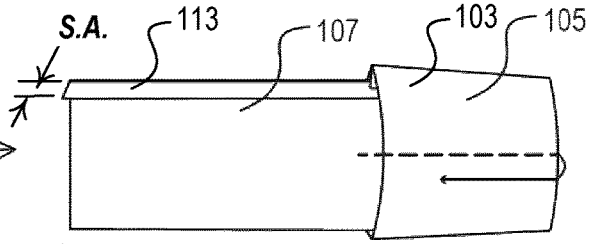

Construction of insulated and vented textile 100 can be challenging and time-consuming since each of the insulated baffles 104 has to be formed and individually attached to the mesh layer 102. One method 300 of construction that may be used in certain embodiments is shown in the step-by-step illustrations of FIGS. 3A, 3B, 3C, 3D, and 3E (collectively, FIG. 3). As discussed below, method 300 helps to reduce the time required for construction and facilitates precision-sewing of the baffles at spaced apart locations along a length of the mesh layer. As the first step (FIG. 3A), exterior fabric 105 is cut into a rectangular piece having a width w (typically extending along the fabric's cross grain direction c), and a length/(typically extending along the fabric's grainline direction g). Fabric 105 is folded in half longitudinally along the fold line 111A, with right sides 103 of the fabric together. The folded piece of fabric, with the fabric back sides 107 facing outward, is then stitched along longitudinal seam line 111B with a seam allowance S.A. (see FIG. 3B). The line of stitching 117 along the seam line 111B produces a casing 122 for receiving insulation material. After stitching along seam line 111B, the casing 122 is turned right side out (see FIG. 3C) so that the right side 103 of the fabric is facing out and the seam allowance edges 113 of the fabric 105 are concealed within the casing 122.

Figure 3D:
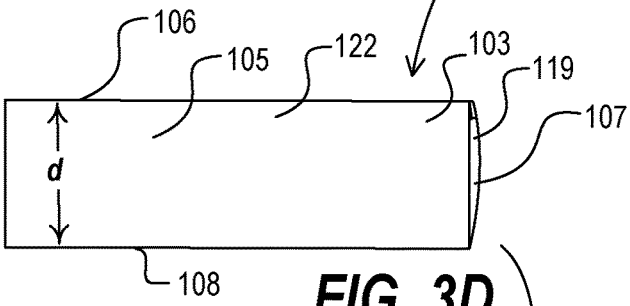
Figure 3E:
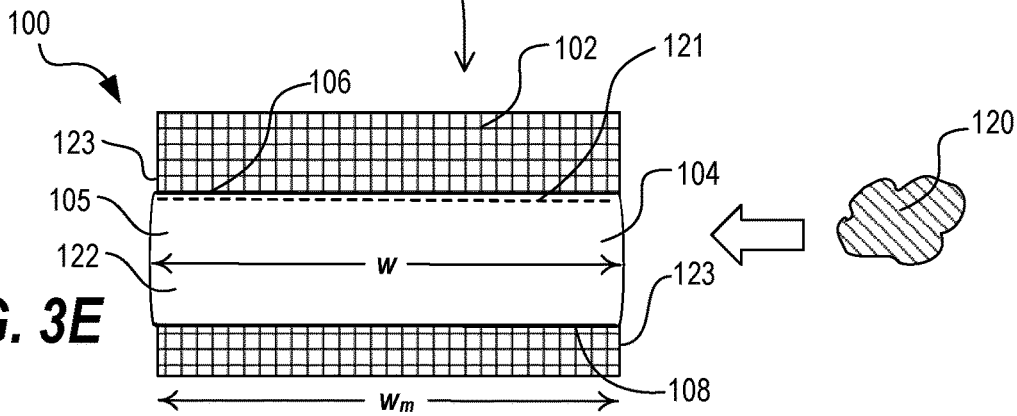

The width w of the piece of fabric 105 may be at least the same width $w_m$ of the piece of mesh material 102 to which the baffle will be attached (see FIG. 3E). The length/is such that when the piece of exterior fabric 105 is formed into a casing 122 as seen in FIG. 3D with seam allowances (S.A.) 113 inside the casing, the casing 122 has the desired distance d between the first longitudinal edge 106 and second longitudinal edge 108 of each baffle 104. In other words, length/=2*d+2*S.A.

Following the steps illustrated in FIGS. 3A, 3B, 3C and 3D, the piece of fabric 105 is formed into a casing 122 or tube which has an opening 119 at either end for receiving insulation material 120. Prior to attaching the casing 122 to the mesh layer 102 and inserting insulation material 120 into the casing 122, the turned casing 122 (with right side 103 of fabric facing out) may be pressed and/or ironed to neaten the seams and folds.

In FIG. 3E, the casing 122 that is made from folding, stitching and turning the piece of fabric 105, is placed on top of the mesh layer 102 (which has been cut to the size and shape desired for an insulated and vented panel that will be installed in a garment), such that the casing extends longitudinally across the width $w_m$ of the mesh layer 102. The casing is attached to the mesh layer 102 with a line of stitching 121 adjacent to the baffle edge 106. The other baffle edge 108 is left free (i.e. it is not stitched or otherwise attached to the mesh layer 102). To complete the construction of the baffle 104, insulation material 120 is inserted into the casing through the opening 119.

A plurality of casings may be constructed from pieces of exterior fabric 105 in the manner as described with reference to FIGS. 3A, 3B, 3C and 3D, and attached to mesh layer 102 in parallel rows (spaced so that there is some overlap between adjacent rows of baffle casings), and stuffed with insulation material 120 to provide a panel of insulated and vented textile 100 having insulated baffles 104 as seen in FIG. 1. To ensure consistent construction and insulating properties between all of the rows of baffles 104, similar quantities of insulation material may be inserted into each baffle casing of the same length.

Whereas conventional quilting methods involve stitching through all of the layers including the outer and interior fabric layers and the middle insulation layer, the construction method 300 of FIG. 3 comprises sewing the casing to the mesh layer 102 prior to filling the casing with insulation material. The elongate shape of the casing 122 ensures that the insulation material 120 is encased and held in place without the need for any additional quilting step or top-stitching to be applied following the construction and installation of the baffles 104 to the mesh layer 102 in accordance with method 300. In addition, method 300 has advantages over conventional quilting techniques in the construction of insulated baffles 104, as it is more efficient to stitch the casings in rows at the desired locations on mesh layer 102 and along the fixed edge 106 of each casing (leaving the other edge 108 unattached) if the casings are not yet filled with insulation material. Method 300 also facilitates increased precision of the stitching since the attachment of the unfilled casings requires stitching only through the fabric 105 and the mesh layer 102. However, if the baffles were formed such that insulation material is already in the casing prior to attaching the casing to the mesh layer, the presence of insulation could change the shape of the casing, which could prevent or impede precise positioning of the baffle 104 on the mesh layer 102. It could also prevent or impede precise stitching at the desired locations on mesh layer 102 and along edge 106, as one would need to sew through all of the layers, including the exterior fabric 105, the insulation material 120 and the mesh layer 102.

In some embodiments, the panel edges, including the edges 123 extending along the grainline direction g, may be left raw/unfinished, as a process of sewing the panel into the garment may be used which hides the unfinished edges (e.g. inside the lining). Alternately, the panel edges may be serged, finished with binding, or finished using other techniques, prior to or after installation of the panel in the garment.

The combination and arrangement of the mesh layer 102 and insulated baffles 104 operate to provide both insulation and ventilation to the wearer. The mesh layer 102 provides a plurality of openings therethrough to provide for ventilation through the textile 100. As each of the baffles 104 is attached to the mesh layer 102 only along first longitudinal edge 106, but is otherwise left unattached along the second longitudinal edge 108, moisture is free to exit through the mesh layer 102 and under the baffle 104 toward the baffle 104's second longitudinal edge 108, in the direction shown by the arrows a (see FIG. 1). This allows for air and moisture to circulate, thereby providing for ventilation of the garment 200. Moisture generated by the wearer can escape the garment 200 through the mesh layer 102 and under the baffles 104. This ventilation feature reduces undesirable moisture build-up under the garment 200 as the wearer perspires during exertion and activity. In addition, since the baffles 104 are insulated, they provide warmth to the wearer by retaining heat generated by the wearer and shielding the wearer from the cold outside air. The overlapping arrangement of the baffles 104 shown in the FIG. 1 embodiment further improves warmth and insulation.

Textile 100 can be used to construct a garment where both insulation and ventilation are desired. For example, textile 100 can be incorporated into a jacket. As seen in FIG. 2, textile 100 is used to construct a portion of the back of garment 200, wherein the portion consists of a back panel 114 below the upper back yoke 115 of the jacket. The yoke 115 may be made of regular insulated material. The back panel 114 is made from textile 100 incorporating the insulated baffles 104 and mesh layer 102 as described herein. Textile 100 provides ventilation at the back of the wearer where perspiration is likely to occur. Textile 100 also provides insulation and warmth through the insulated baffles 104. The insulated baffles 104 may be arranged in overlapping fashion as described with reference to FIG. 1 to shield the wearer from wind and cold air and to retain the heat of the wearer within the garment 200.

Textile 100 can be used to construct other types of garments, and in particular, may be used in areas of garments where both insulation and ventilation are desired. Any insulated apparel may benefit from incorporating textile 100, including, for example, vests, coats, pants, headwear (such as hats, toques, caps), shoes, boots, and the like. Such apparel may be used outdoors and in cooler temperatures, and provide increased comfort and functionality for the wearer by retaining heat and releasing moisture.

In preferred embodiments, each insulated and vented panel is individually assembled for every product by cutting the pieces of exterior fabric 105 for the baffles 104 and the mesh layer 102 to the shape and size needed to construct the particular insulated and vented panel to be inserted in a garment. This allows the panel to be customized for various garment designs and applications, and to accommodate different shapes, sizes, and styling of the garment, including by varying the positioning of the baffles, width and length of the baffles and the textile panel, and materials used for the construction of the mesh layer and insulated baffles.

In alternate embodiments, a large sheet of insulated and vented textile 100 is pre-assembled with the insulated baffles and mesh (and made into a roll of fabric, for example), and then cut to the desired size and shape for installation in a garment.

In some embodiments, the insulated baffles 104 may incorporate one or more closures to allow for the customization of the extent of insulation and ventilation according to the wearer's preferences or needs. Such closures may include, for example: buttons or other such fasteners, zippers, hook and loop tape, ties, magnetic closures, and the like. For example, the closures may comprise snap button fasteners positioned in the overlapping area between adjacent baffles 104. If the wearer desires more warmth and less ventilation, they may fasten the buttons to keep the baffles 104 closed. Alternately, if the wearer desires more ventilation, they may unfasten the buttons, thereby allowing baffles 104 to open. If the wearer desires more ventilation in certain areas, they may selectively unfasten the buttons in certain areas of the garment 200, while fastening the buttons in other areas of the garment 200. Instead of buttons, zippers or hook and loop tape may be sewn into or otherwise attached to the overlapping areas of the baffles 104 to similarly allow for opening and closing of the baffles 104.

In some embodiments, a panel of insulated and vented textile 100 for garment construction comprises between five (5) to fifteen (15) insulated baffles 104 attached to mesh layer 102. In certain embodiments, for example, a panel of insulated and vented textile 100 for use as the back panel of a jacket or vest may comprise ten (10) insulated baffles 104. In other embodiments, a different number of insulated baffles 104 may be provided in the insulated and vented textile 100 (for example, one, two, three, or four insulated baffles 104) depending on the garment and particular portion of or application within the garment.

In the illustrated embodiment of FIG. 2, the garment 200 comprises a single panel of insulated and vented textile 100 in the back of the jacket. However, in other garments, multiple panels of insulated and vented textile 100 having the same or varying numbers, sizes and/or shapes of insulated baffles 104 may be used to construct a garment.

In alternate embodiments mesh layer 102 may be replaced with other breathable materials that are not necessarily categorized as "mesh" fabrics. For example, tencel, linen, silk, rayon, cotton, gauze, micro modal or merino wool fabric, or certain types of breathable polyester fabric and the like may be used for the layer 102 of fabric that supports the insulated baffles 104. The fabric that is used as layer 102 may be a woven, knit or jersey. In some embodiments, the fabric used for layer 102 may be perforated or have one or more openings therethrough for airflow and to increase the ventilation properties of the insulated and vented textile 100.

The examples and corresponding diagrams used herein are for illustrative purposes only. Different configurations and terminology can be used without departing from the principles expressed herein.

Although the invention has been described with reference to certain specific embodiments, various modifications thereof will be apparent to those skilled in the art without departing from the scope of the invention. The scope of the claims should not be limited by the illustrative embodiments set forth in the examples, but should be given the broadest interpretation consistent with the description as a whole. For example, various features are described herein as being present in "some embodiments" or in "one embodiment". Such features are not mandatory and may not be present in all embodiments. Embodiments of the invention may include zero, any one or any combination of two or more of such features. This is limited only to the extent that certain ones of such features are incompatible with other ones of such features in the sense that it would be impossible for a person of ordinary skill in the art to construct a practical embodiment that combines such incompatible features. Consequently, the description that "some embodiments" possess feature A and "some embodiments" possess feature B should be interpreted as an express indication that the inventors also contemplate embodiments which combine features A and B (unless the description states otherwise or features A and B are fundamentally incompatible).

The invention claimed is:

1. A textile for use in constructing a garment, the textile comprising:

(a) a mesh layer comprising a breathable fabric having a plurality of openings therethrough; and (b) a plurality of insulated baffles comprising insulating material, each one of the plurality of insulated baffles defined by a first longitudinal edge and a second longitudinal edge, wherein each one of the plurality of insulated baffles is attached to the mesh layer along the first longitudinal edge of the baffle while the second longitudinal edge of the baffle is left unattached.

2. The textile according to claim 1 wherein the plurality of insulated baffles are arranged in parallel rows at spaced intervals along a length of the mesh layer.

3. The textile according to claim 1 wherein the plurality of insulated baffles is attached to the mesh layer in an overlapping manner.

4. The textile according to claim 1 wherein the plurality of insulated baffles comprises an upper baffle and a lower baffle adjacent to the upper baffle, and wherein the upper baffle and lower baffle are attached to the mesh layer such that the second longitudinal edge of the upper baffle is below the first longitudinal edge of the lower baffle.

5. The textile according to claim 1 wherein the plurality of insulated baffles comprises an upper baffle and a lower baffle adjacent to the upper baffle, and wherein the upper baffle and lower baffle are attached to the mesh layer such that a spacing s between the first longitudinal edge of the upper baffle and the first longitudinal edge of the lower baffle is less than a distance d between the first longitudinal edge and the second longitudinal edge of the upper baffle.

6. The textile according to claim 1 wherein the mesh layer comprises a stretch mesh material.

7. The textile according to claim 1 wherein each one of the plurality of insulated baffles comprises an exterior fabric forming a casing, and the insulation material is located within the casing.

8. The textile according to claim 1 comprising one or more closures for selectively opening and closing the plurality of insulated baffles.

9. The textile according to claim 8 wherein the closures comprise one or more of: button fasteners, zippers, hook and loop tape, magnetic closures, and ties.

10. Apparel incorporating a textile for use in constructing a garment, the textile comprising:

(a) a mesh layer; and (b) a plurality of insulated baffles, each one of the plurality of insulated baffles defined by a first longitudinal edge and a second longitudinal edge, wherein each one of the plurality of insulated baffles is attached to the mesh layer along the first longitudinal edge of the baffle while the second longitudinal edge of the baffle is left unattached.

11. The apparel according to claim 10 wherein the apparel comprises an outerwear garment and the textile is sewn in as a back panel of the outerwear garment.

12. A method for constructing a textile, comprising:

providing a mesh layer comprising a breathable fabric having a plurality of openings therethrough;

providing a plurality of casings, each one of the plurality of casings formed from an elongate fabric piece which is folded longitudinally to form the casing, wherein the casing is defined by a first longitudinal edge and a second longitudinal edge;

arranging the plurality of casings at spaced intervals along a length of the mesh layer;

attaching each one of the plurality of casings to the mesh layer along the first longitudinal edge of the casing while leaving the second longitudinal edge of the casing unattached; and inserting insulation material into each one of the plurality of casings.

13. The method according to claim 12, wherein each one of the plurality of casings is formed by bringing opposing lengthwise edges of the elongate fabric piece together to form a longitudinal fold, and sewing along the lengthwise edges.

14. The method according to claim 13, wherein each one of the plurality of casings is turned inside out subsequent to sewing along the lengthwise edges.

15. The method according to claim 12, wherein each one of the plurality of casings is attached to the mesh layer by sewing along the first longitudinal edge of the casing.

16. The method according to claim 12 comprising attaching the plurality of casings to the mesh layer in an overlapping manner.

17. The method according to claim 12, wherein the plurality of casings comprises an upper casing and a lower casing adjacent to the upper casing, and wherein the upper casing and lower casing are attached to the mesh layer such that the second longitudinal edge of the upper casing is below the first longitudinal edge of the lower casing.

18. The method according to claim 12 wherein the plurality of casings comprises an upper casing and a lower casing adjacent to the upper casing, and wherein the upper casing and lower casing are attached to the mesh layer such that a spacing s between the first longitudinal edge of the upper casing and the first longitudinal edge of the lower casing is less than a distance d between the first longitudinal edge and the second longitudinal edge of the upper casing.

19. The method according claim 12, comprising inserting insulation material into each one of the plurality of casings after the plurality of casings is attached to the mesh layer.

20. A textile manufactured in accordance with the method of claim 12.

* * * * *